US008594348B2

(12) United States Patent
Windischberger et al.

(10) Patent No.: US 8,594,348 B2
(45) Date of Patent: Nov. 26, 2013

(54) ASYMMETRICAL MOVING SYSTEMS FOR A PIEZOELECTRIC SPEAKER AND ASYMMETRICAL SPEAKER

(75) Inventors: Susanne Windischberger, Vienna (AT); Josef Lutz, Rohrau (AT)

(73) Assignee: Knowles Electronics Asia PTE. Ltd., Singapore (SG)

( * ) Notice: Subject to any disclaimer, the term of this patent is extended or adjusted under 35 U.S.C. 154(b) by 947 days.

(21) Appl. No.: 12/093,633

(22) PCT Filed: Nov. 14, 2006

(86) PCT No.: PCT/IB2006/054237

§ 371 (c)(1), (2), (4) Date: May 14, 2008

(87) PCT Pub. No.: WO2007/054919

PCT Pub. Date: May 18, 2007

(65) Prior Publication Data

US 2008/0292119 A1 Nov. 27, 2008

(30) Foreign Application Priority Data

Nov. 14, 2005 (EP) ..... 05110716

(51) Int. Cl.
*H04R 25/00* (2006.01)

(52) U.S. Cl.
USPC ..... 381/190

(58) Field of Classification Search
USPC ..... 381/190
See application file for complete search history.

(56) References Cited

U.S. PATENT DOCUMENTS

| | | | | |
|---|---|---|---|---|
| 4,439,640 | A | 3/1984 | Takaya | |
| 5,030,872 | A | 7/1991 | Boehnke et al. | |
| 5,142,510 | A * | 8/1992 | Rodda | 367/163 |
| 5,805,726 | A | 9/1998 | Yang et al. | |
| 6,332,029 | B1 * | 12/2001 | Azima et al. | 381/152 |
| 6,795,561 | B1 * | 9/2004 | Bank | 381/152 |
| 6,836,552 | B1 * | 12/2004 | Bachmann et al. | 381/431 |
| 2003/0059069 | A1 | 3/2003 | Bank et al. | |

FOREIGN PATENT DOCUMENTS

| | | | |
|---|---|---|---|
| EP | 1422970 | A2 | 5/2004 |
| GB | 1122698 | A | 8/1968 |
| JP | 57-113697 | A | 7/1982 |
| JP | 9-135496 | A | 5/1997 |
| WO | 0015000 | A1 | 3/2000 |
| WO | 03013180 | A2 | 2/2003 |

* cited by examiner

*Primary Examiner* — Calvin Choi
(74) *Attorney, Agent, or Firm* — Steven McMahon Zeller; Dykema Gossett PLLC

(57) ABSTRACT

A moving system (3) for a piezoelectric speaker (1) may include a membrane (4) and a piezoelectric layer (5) attached thereto, wherein a movement of the moving system (3) in a main direction (MD) is substantially caused by dilatation/contraction of the piezoelectric layer (5) transverse to the main direction (MD). To provide an advantageous frequency response of the moving system (3), it is built up asymmetrically with respect to the moving characteristics. Accordingly, the modes are frequency shifted on the one hand and of less influence on the other. Hence, the frequency response of an inventive speaker (1) has less elevations and depressions in the frequency response. In a preferred embodiment the local compliance and/or the shape of the moving system (3) is asymmetric with respect to any point in the plane of the moving system (3).

13 Claims, 5 Drawing Sheets

ASYMMETRICAL MOVING SYSTEMS FOR A PIEZOELECTRIC SPEAKER AND ASYMMETRICAL SPEAKER

FIELD OF THE INVENTION

The invention relates to a moving system for a piezoelectric speaker, comprising a membrane and a piezoelectric layer attached thereto, wherein a movement of the moving system in a main direction is substantially caused by dilatation/contraction of the piezoelectric layer transverse to said main direction. Furthermore, the invention relates to a piezoelectric speaker comprising an inventive moving system.

BACKGROUND OF THE INVENTION

Piezoelectric speakers are well known in the prior art. In contrast to so-called dynamic speakers where a membrane is moved by a coil in a magnet system, a membrane of a piezoelectric speaker is moved by a piezoelectric crystal. Piezoelectricity is the ability of certain crystals to generate a voltage in response to applied mechanical stress. The piezoelectric effect is reversible, meaning that piezoelectric crystals can change shape by a small amount when an external voltage is applied. The deformation is quite small, but sufficient to produce sound.

In the prior art two kinds of piezoelectric speakers are known: speakers having a excitation in a direction transverse to the plane of the membrane, that is to say in the direction of the sound emanation, and speakers having an excitation in a direction parallel to the plane of the membrane, that is to say transverse to the direction of the sound emanation. The first kind of piezoelectric speakers work in a similar way to dynamic speakers with a moving coil where the excitation area of the membrane, i.e. the area where force is induced into the membrane, performs a more or less translatory movement (in the following also referred as type A speaker). In contrast, the movement of a membrane of a piezoelectric speaker of the second kind, comprises no substantial translatory component, but substantially a bending component (in the following also referred as type B speaker). Consequently, the mechanical and hence the acoustic behavior of these two types is completely different, which is outlined hereinafter.

At this point a difference should be made between the excitation of a membrane and the movement caused thereby. Whereas the excitation of type A and type B speakers are transverse to one another, in both cases the membrane moves in a main direction causing the surrounding air to compress and decompress. Consequently, a sound wave is emitted in this main direction, which strictly speaking is the summation vector of sound vectors in the different directions. Normally, this main direction is simply the axis of the speaker. It should further be noted that applying a voltage to a piezoelectric crystal causes a dilatation/contraction in a main deformation direction. However, there is also a small deformation in the other axis, which for the sake of the invention is neglected. Finally, it should be noted that a substantial translatory component of the movement of the membrane does not exclude another moving component, in particular a bending component, and vice versa. However, a substantial translatory component/substantial bending component means that translation/bending prevails.

When a membrane of a type A speaker is excited, besides the translatory movement of the excitation area of the membrane there are also other components of movement of the remaining areas. Firstly, the area between the edge of the membrane, which is normally fixed to a housing, and the excitation area, moves according to the translatory movement of the excitation area relative to the fixed edge. Accordingly, said area performs a kind of rolling (compensation) movement, because of which it is generally much more compliant than the center area, which center area does not need to perform a compensation movement. Moreover, the so-called dome, which is the inside of the ring-shaped excitation area in case of common dynamic speakers, is bent upwards and downwards due to acceleration forces and pressure forces. However, there are also speakers with a more or less rigid plate serving as a membrane where said bending may be neglected. In any case, a membrane in addition tends to move according to its natural oscillation when it is excited. These oscillations are also known as standing waves or so-called modes. The frequency and amplitude of each mode depends on various parameters, such as shape and dimension of said membrane as well as material and thickness. This behavior and the consequences thereof are explained hereinafter with reference to the FIGS. 1 to 3:

FIG. 1 shows a cross section as well as a top view of a type A piezoelectric speaker 1', which comprises a housing 2, a membrane 4 and a piezoelectric crystal 5'. The membrane 4 is connected to the housing 2 at the membrane's edges, e.g. by means of a glue. In the resulting space the piezoelectric crystal 5' is attached between the housing 2 and the membrane 4. By applying a voltage across the piezoelectric crystal 5', it dilates or contracts so that the membrane 4 is moved upwards (indicated with thin lines) or downwards in a main direction MD thus compressing or decompressing the air above the membrane 4 causing sound. To ease this movement, the membrane 4 comprises a corrugation at the outer section as can be seen in FIG. 1. This measure makes the membrane 4 softer at the outer section, that is to say increases the compliance. In contrast, the membrane 4 is stiffer in the center area. Hence, one will of course appreciate that the center/excitation area of the membrane 4 is moved mainly transitorily. Besides the translatory movement shown in FIG. 1 there are also further movements, e.g. the standing waves mentioned before.

FIG. 2 shows the movement of the membrane 4 (simply shown by a bold line) according to these standing waves or modes. On the left there is shown the first order mode, that is to say the bending of the membrane 4 according to its natural resonant frequency. Besides, there are harmonics. In FIG. 2 the first (center) and the second harmonic (right hand), that is to say, the second and third order modes are shown where the membrane 4 has one or two nodes respectively. The volume, which is shifted by the membrane 4 is visualized by a hatched area. One will easily appreciate that only the odd modes cause a substantial sound pressure since the sum of the hatched areas above and below the idle position of the membrane 4 is unequal to zero, whereas said sum in case of even modes causes substantially no sound.

FIG. 3 now shows the frequency response of the speaker 1', taking into consideration the teachings of FIG. 2. On the abscissa the frequency f is shown, on the ordinate the sound pressure p. Every odd mode n=1, 3, . . . causes an elevation in the frequency response (due to the moved volume), every even mode n=2, 4, . . . a depression (no moved volume but dissipation of input power due to inner friction). It should be noted that the conditions are simplified in this graph and the graph is just for illustrating the general physical correlations. The frequency response of a real speaker may have a completely different frequency response.

However, this behavior of the speaker is not wanted as these elevations and depressions cause varying loudness at different frequencies. A number of methods have been found to damp these modes so as to decrease their influence so that the frequency response of a speaker gets as flat as possible. One method is to make the center area of the membrane sufficiently stiff so that natural modes only occur at higher frequencies. In this case often two materials are used, a rigid one for the center area and a soft one for the edge area. One further method is disclosed in GB1122698 where asymmetrical membranes are proposed, which are excited in the center of gravity. Yet another method is to shift the point of excitation of a symmetrical membrane away from the center of gravity, so that the disturbing modes are less excited. However, the frequency respectively the wavelength of the modes of the membrane 4 itself is not changed thereby. What is ideally left when designing a type A speaker is the so called "piston mode", which is illustrated in FIG. 1 (got its name because the membrane in the center area moves like a piston, that is to say transitorily). It should be noted at this point that the piston mode should not be confused with the first order mode, which first order mode moves in the opposite direction to the piston mode.

Turning now to type B speakers, a completely different physics is presented. FIG. 4 shows the principle design of such a device in cross section as well as in a top view. The type B piezoelectric speaker 1 comprises a housing 2, a membrane 4 and a piezoelectric layer 5. The membrane 4 again is connected to the housing 2 at the membranes edges, e.g. by means of a glue. In contrast to a type A speaker, here the piezoelectric crystal exists in the form of a piezoelectric layer 5, which is attached to membrane 4 without touching the housing 2. Again, the piezoelectric crystal 5 dilates or contracts by applying a voltage so that the membrane 4 is moved upwards (indicated in thin lines) or downwards in a main direction MD. In contrast to type A speakers, the piezoelectric layer 5 dilates or contracts in a direction transverse to said main direction MD, that is to say in the plane of the membrane 4 in the present example. Therefore, the excitation area is not moved transitorily, but bent. However, also said bending compresses or decompresses the air above the membrane 4, causing sound. To ease this movement, the membrane 4 again comprises a corrugation at the outer section. This measure makes the membrane 4 softer at the outer section, that is to say, increases the compliance. In contrast to a type A speaker, the edge of the center/excitation area is not moved, but only turned. Again, there are standing waves besides the bending movement shown in FIG. 4.

The physics of the standing waves is to a large extent the same as for type A speakers so that a separate discussion is omitted for the sake of brevity. However, in contrast to a type A speaker, a type B speaker has to have odd modes n= 1, 3, . . . . Otherwise, if they will be completely damped, there is no sound any more since there is no piston mode, which would generate sound.

Nevertheless, the type B speakers suffer from similar problems with respect to the frequency response, since here odd modes cause elevations and even modes cause depressions in the frequency response as well. Unfortunately, the teachings for type A speakers are not generally applicable to type B speakers. It is particularly impossible to apply the teachings of a rigid plate with a soft border area. One will easily understand that the bending of the membrane is essential for the function of the speaker. Therefore, a rigid membrane is a contradiction to a good efficiency of a type B speaker. Moreover, it is particularly impossible to apply the teachings with respect to shifting the point of excitation as mentioned above. Whereas the excitation area of type A speakers is comparatively small, that is to say 5% of the total membrane area, the excitation area of type B speakers is comparatively large, that is to say 20% of the total membrane area and more. One skilled in the art of course will understand that for the function of a type A speaker the dimension of the excitation area is more or less irrelevant, assuming that the membrane is sufficiently rigid in the center area. Accordingly, it is also clear that a type B speaker cannot be excited at a single point, but has to be excited in a sufficiently large area. Normally, the excitation area of a type B speaker is equivalent to the area of the piezoelectric layer. Only if the piezoelectric layer is partly attached to the speaker housing, for instance if the whole membrane comprises a piezoelectric layer because of easier manufacturing, those parts do not contribute to the excitation area. Finally, the first order mode of a type A speaker and a type B speaker show a completely different behavior. In a type A speaker the first order mode moves in the opposite direction to the piston mode, which means that the first order mode reduces the loudness of a type A speaker. In contrast, the first order mode is the one that (mainly) produces the sound of a type B speaker. One will of course understand that a designer of a type A speaker aims to get rid of the bending modes. In particular, he will try to avoid the influence of the first order mode as much as possible as this one has the greatest impact on loudness reduction mentioned above. However, if a designer tries also to avoid the first order mode when designing a type B speaker, he will of course fail to make a speaker of sufficient performance.

Hence, it is an object of the invention, to provide a type B speaker that has a substantially flat frequency response and design rules therefor.

OBJECT AND SUMMARY OF THE INVENTION

The object of the invention is achieved by a moving system for a piezoelectric speaker, comprising a membrane and a piezoelectric layer attached thereto, wherein a movement of the moving system in a main direction is substantially caused by dilatation/contraction of the piezoelectric layer transverse to said main direction and wherein said moving system is built up asymmetrically with respect to the moving characteristics.

The object of the invention is furthermore achieved by a piezoelectric speaker, comprising an inventive moving system.

The modes of an asymmetrical moving system are completely different than those of a symmetrical one. The asymmetry of the speaker leads to a broadening and a frequency shift of the modes on the one hand, and to an equalization of even and odd modes on the other. Even modes get smaller and odd modes get higher as the effects, which were discussed for a symmetrical moving system, are less distinctive in an asymmetrical system. Hence, the frequency response of an inventive speaker has less elevations and depressions in the frequency response, which is normally aimed at in speaker design. Since the type B speaker has no piston mode, it is essential that the natural bending modes of the moving system be designed such that they emit sound, in contrast to a standard type A speaker design in which the natural bending modes are avoided as much as possible. Therefore, a computer simulation by means of a finite elements method (FEM) seems to be inevitable due to the complicated physics of an asymmetrical system.

It is advantageous if the local moving characteristics are asymmetrical with respect to any point in the plane of the moving system, so that not any symmetrical oscillation can emerge. This means that the moving system is "completely" asymmetrical. Hence, no mirror point in the plane can be found, for which counts: For every point A in the plane of the membrane there exists a mirrored point B having the same local moving characteristics.

It is highly advantageous if the local compliance is asymmetrical with respect to any point in the plane of the moving system. This means that the moving system is "completely" asymmetrical with respect to the local compliance. Hence, no mirror point in the plane can be found, for which counts: For every point A in the plane of the membrane there exists a mirrored point B having the same local compliance, which local compliance is a result of the local Young's modulus of the membrane material and the thickness of the material. Hence, the Young's modulus of the membrane and/or the thickness of the membrane may be varied to provide asymmetry. In an advantageous embodiment the asymmetry is higher than 20%, meaning that the difference between the local compliance in at least one point A and a corresponding point B is higher than 20%. In a more advantageous embodiment the asymmetry is higher than 40%. Finally, the asymmetry is higher than 60% in a very advantageous embodiment. As the moving system is built up of a membrane and a piezoelectric layer, the asymmetry may be provided by an asymmetry of the membrane and/or the piezoelectric layer.

In yet another advantageous embodiment of the invention the shape of the moving system is asymmetrical with respect to any point in the plane of the moving system. This means that the edges of the membrane or the piezoelectric layer are not symmetrical with respect to a point. Hence, no mirror point in the plane can be found, for which counts: For every point A at the edge of the membrane/the piezoelectric layer there exists a mirrored point B at the edge of the membrane/the piezoelectric layer. In an advantageous embodiment the asymmetry is higher than 10%, meaning that the distance from at least one point A to an arbitrary mirrored point and the distance from a corresponding point B to said mirrored point differ by at least 10%. In a more advantageous embodiment the asymmetry is higher than 20%. Finally, the asymmetry is higher than 30% in a very advantageous embodiment. As the moving system is built up of a membrane and a piezoelectric layer, the asymmetry may be provided by an asymmetry of the membrane and/or the piezoelectric layer.

It is also advantageous if the moving system is symmetrical about a single axis with respect to the moving characteristics. Quite often it is not necessary to provide "total" asymmetry so as to achieve an advantageous frequency response of the moving system. In this case it is sufficient to generally provide asymmetry, but to accept a single axis of symmetry. One example is a trapezoid, which comprises a single axis of symmetry in the geometrical sense. One further example is a moving system, which comprises a rectangular membrane and a rectangular piezoelectric layer, which have only one common axis of symmetry. Finally, it should be noted that this embodiment applies even to symmetrical shapes of the moving system if the mass distribution or variations of the Young's modulus of the materials are of such kind that the moving system is symmetrical about a single axis with respect to the moving characteristics.

It is furthermore advantageous if the membrane and the piezoelectric layer differ in shape. A high degree of asymmetry may be provided by choosing different shapes for the membrane and the piezoelectric layer. One example is to choose a rectangle for the membrane and a circle for the piezoelectric layer and vice versa. A further example is to use a circle for the membrane and an ellipse for the piezoelectric layer. One will of course perceive that the examples mentioned above illustrate the invention rather than fully cover all possible combinations and one skilled in the art can easily find other combinations without departing from the scope of the invention.

In yet another advantageous embodiment of the invention the membrane and the piezoelectric layer are of the same shape. Here the membrane and the piezoelectric layer have the same shape, but not necessarily the same dimension because quite often the piezoelectric layer is smaller than the membrane. So, the membrane as well as the piezoelectric layer may for instance have the shape of two different sized rectangles, in particular rectangles having the same aspect ratio. One skilled in the art will easily appreciate that this is only one example of the great variety of possibilities.

It is also advantageous if the center of gravity of the membrane and the center of gravity of the piezoelectric layer are spaced apart. This is a further method to provide asymmetry. In this case the membrane may even have the same shape as the piezoelectric layer. As a dimension for the asymmetry is taken the distance between the centers of gravity. In a preferred embodiment this distance is more than 10% of the largest extension of the moving system. In yet another preferred embodiment the distance is more than 20%. Finally, it is very advantageous if the distance exceeds 30% of said largest extension.

In an advantageous embodiment of the inventive moving system the membrane is made of a metal. This choice is advantageous as the Young's modulus of a metal is in the same scale as the Young's modulus of the piezoelectric layer. Hence, a contraction/dilatation of the piezoelectric crystal causes a substantial bending of the moving system. Otherwise, if the membrane is too soft, the moving system just more or less contracts/dilates according to the contraction/dilatation of the piezoelectric crystal without a substantial bending component. In contrast, if the membrane is too hard, the piezoelectric crystal is hindered in its contraction/dilatation, so that there is not any substantial movement of the moving system. In a number of cases aluminum is used for the membrane as it is neither too soft nor too hard and in addition has other useful characteristics, for instance its resistance to oxidation (strictly speaking this means that the membrane doesn't collapse even when it has oxidized over a long time). It should be noted that the movement of the moving system does not only depend on the Young's modulus of the materials used, but also on the dimensions of the moving system, i.e. on its thickness. Accordingly, a layer made of a material with a lower Young's modulus can be made thicker so as to make the membrane/the piezoelectric layer less compliant and vice versa. In a preferred embodiment the membrane and the piezoelectric layer have the same compliance.

In a further preferred embodiment of the moving system the membrane is made of a piezoelectric layer as well. Accordingly, the moving system consists of two piezoelectric layers attached to one another. At least one of them takes over the role of a membrane, meaning that it is provided for an airtight sealing to the housing as well as for the generation of sound. At least the latter functionality cannot be separated from the second piezoelectric layer, which also causes a bending movement of the moving system and consequently the generation of sound. Advantageously, both layers have the same Young's modulus and the same compliance respectively so as to provide a largest possible bending movement. It is clear that the piezoelectric layers have to be excited in opposite directions, that is to say that the upper layer has to dilate when the lower layer contracts and vice versa.

Finally, it is advantageous if the area of the piezoelectric layer is larger than 20% of the total membrane area. To provide a satisfying operation of an inventive speaker the piezoelectric layer should cover a sufficient part of the membrane as stated above. 20% is a good starting point, whereas at least 50% and furthermore at least 80% coverage are advantageous developments.

These and other aspects of the invention are apparent from and will be elucidated with reference to the embodiments described hereinafter.

BRIEF DESCRIPTION OF THE DRAWINGS

The invention will be described in greater detail hereinafter, by way of non-limiting examples, with reference to the embodiments shown in the drawings.

DESCRIPTION OF EMBODIMENTS

Figure 4:
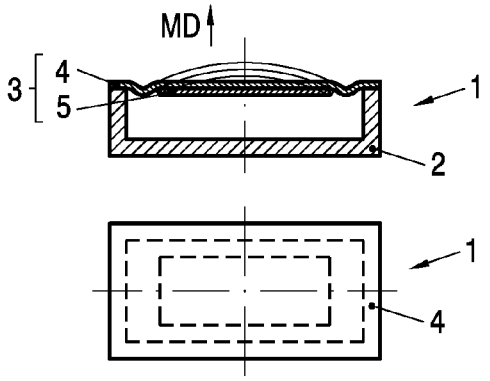
Fig.4 (Prior Art)
FIG. 4 shows different views of a prior art type B piezoelectric speaker.
Figure 5:
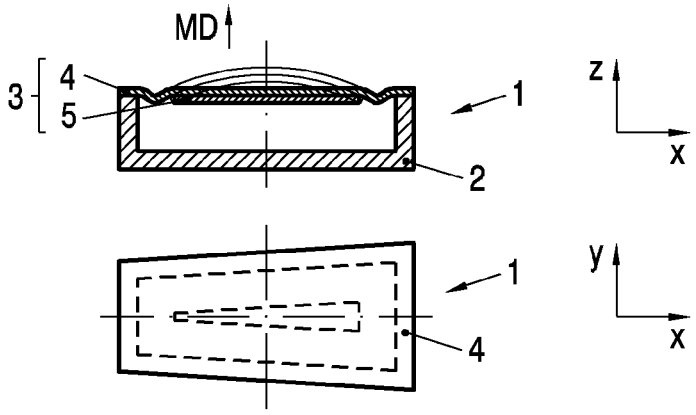
FIG. 5 shows different views of an inventive type B piezoelectric speaker.

FIG. 5 shows a cross section as well as a top view of an inventive type B piezoelectric speaker 1, which comprises a housing 2, a membrane 4 and a piezoelectric layer 5. The membrane 4 again is connected to the housing 2 at the membranes edges, e.g. by means of a glue. In contrast to the speaker shown in FIG. 4, the moving system 3 of the present speaker 1 is asymmetrical with respect to the moving characteristics because the membrane 4 itself as well as the piezoelectric layer 5 are trapezoid-shaped. Again, by applying a voltage the piezoelectric layer 5 dilates or contracts so that the membrane 4 is moved upwards or downwards in a main direction MD. In contrast to the speaker shown in FIG. 4, the inventive moving system 3 has a moving characteristic as shown in FIG. 6.

Figure 1:
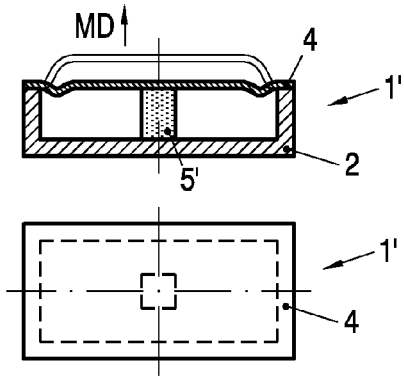
Fig.1 (Prior Art)
FIG. 1 shows different views of a type A piezoelectric speaker.
Figure 2:
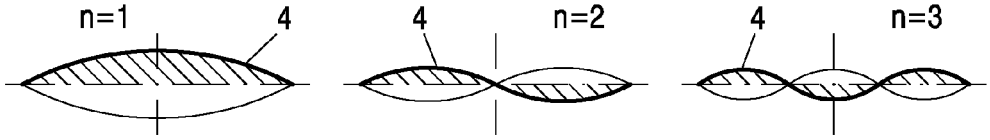
Fig.2 (Prior Art)
FIG. 2 shows the movement of the membrane of a type A piezoelectric speaker.
Figure 6:
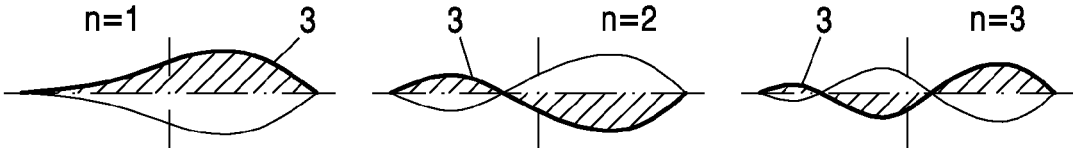
FIG. 6 shows the movement of the membrane of an inventive type B speaker.

FIG. 6 shows the movement of the moving system 3 (simply shown by a bold line) showing again its standing waves or modes. On the left is shown the first order mode, that is to say, the bending of the moving system 3 according to its natural resonant frequency. In contrast to the movement shown in FIG. 2, here the moving system 3 or its membrane 4 is bent asymmetrically. In addition,—due to the asymmetry—also the harmonics show an asymmetrical deformation. In FIG. 6 the first (center) and the second harmonic (right hand), that is to say the second and third order modes are shown where the membrane 4 or the moving system 3 has one or two nodes respectively. The volume, which is shifted by the membrane 4 is visualized by a hatched area. In contrast to the movement of symmetrical moving systems, the present moving system 3 shows oscillations with different wavelengths. Whereas the left half-wave is comparatively quiet and has a short wavelength, the right half-wave is comparatively loud and has a long wavelength. Accordingly, the third mode consists of three different half-waves and so on. One will easy appreciate, that here also the even modes cause a substantial sound pressure since the sum of the hatched areas above and below the idle position of the membrane 4 is unequal to zero.

Figure 3:
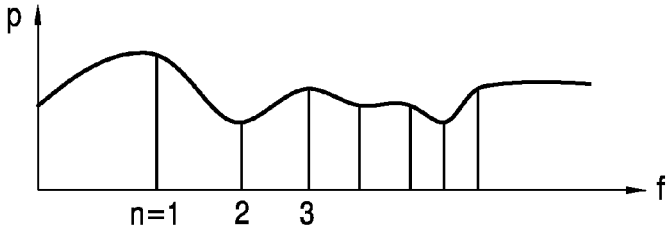
Fig.3 (Prior Art)
FIG. 3 shows the frequency response of a type A piezoelectric speaker.
Figure 7:
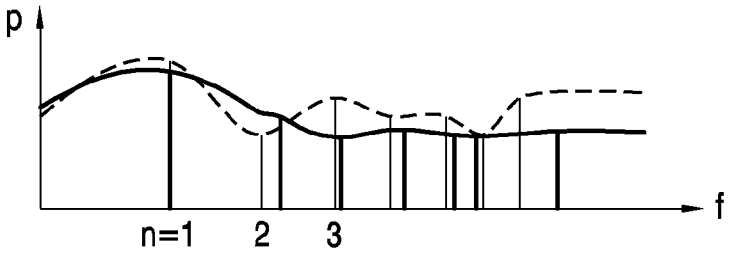
FIG. 7 shows the frequency response of an inventive type B piezoelectric speaker.

FIG. 7 shows the frequency response of an inventive speaker 1, taking into consideration the teachings of FIG. 6. On the abscissa the frequency f is shown, on the ordinate the sound pressure p. For a better understanding, the frequency response of FIG. 3 (dashed line) as well as the its modes n=1, 2, 3, . . . (thin lines) are shown. Whereas the first mode is of the same frequency and more or less the same loudness, the further modes show a completely different behavior. As stated before, the asymmetry of the speaker 1 leads to a broadening and a frequency shift of the modes as well as to a less distinct effect compared to symmetrical systems. The modes related to the inventive, asymmetrical moving system 3 are shown in FIG. 7 by means of bold lines. One will of course appreciate that the frequency response of an inventive speaker 1 has less elevations and depressions in the frequency response what is normally aimed in speaker design. Again, it should be noted that the conditions are simplified in this graph and the frequency response of a real speaker may have a completely different pattern. FIG. 7 is just to illustrate what happens when an asymmetrical moving system is used and how the characteristics of such a system can be used to design an advantageous frequency response.

Since the type B speaker has no piston mode, it is essential that the natural bending modes of the moving system are designed such that sound is emitted, in contrast to a standard type A speaker design, where the natural bending modes are avoided as far as possible. As it is more or less impossible to quote a formula, that covers each and every case, in the following some general design rules are presented. These rules should be kept in mind when designing an inventive type B speaker. However, a computer simulation by means of a finite elements method (FEM) seems to be inevitable due to the complicated physics of an asymmetrical system. It should further be noted that FIGS. 6 an 7 only show oscillations in one plane (in the xz-plane). However, the moving system 3 also oscillates in the yz-plane, which movement is also a parameter to steer the design of an inventive type B speaker. Whereas the moving system 3 of FIG. 5 is symmetrical with respect to the x-axis, it can be made completely asymmetrical by pulling one corner of the trapezoid away, thus warping the trapezoid.

Figure 8:
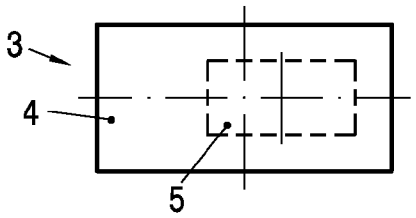
FIG. 8 shows a top view of an inventive moving system, comprising a membrane and a piezoelectric layer having the same shape.

FIG. 8 shows another example of an inventive moving system 3 where the membrane 4 and the piezoelectric layer 5 have the same shape, but where the center of gravity of the membrane 4 and that one of the piezoelectric layer 5 are spaced apart.

Figure 9:
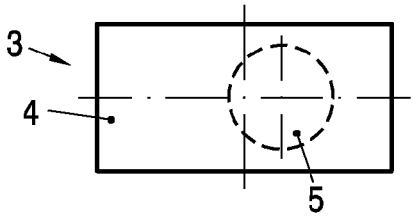
FIG. 9 shows a top view of an inventive moving system, comprising a membrane and a piezoelectric layer having different shapes.

FIG. 9 shows yet another example of an inventive moving system 3 where the membrane 4 and the piezoelectric layer 5 have different shapes, namely a rectangle and a circle, and where in addition the center of gravity of the membrane 4 and that one of the piezoelectric layer 5 are spaced apart.

However, asymmetry cannot be provided only by making the moving system 3 geometrically asymmetrical with respect to an arbitrary point in the plane, but making it asymmetrical by varying the compliance of the moving system 3. A comparatively easy method to choose a certain compliance at a certain point (local compliance) is to vary the thickness of the membrane 4.

Figure 10:
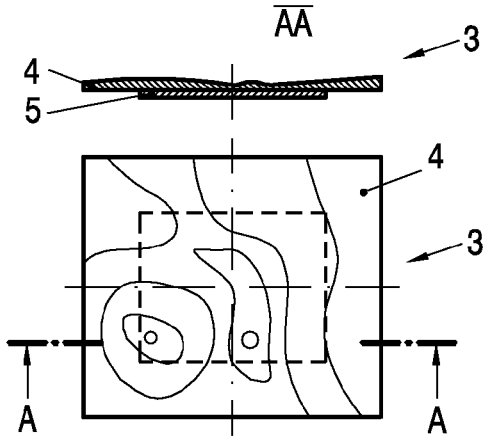
FIG. 10 shows different views of an inventive moving system, comprising a membrane with varying thickness.

FIG. 10 shows a cross section and a top view of such a moving system 3. Whereas the piezoelectric layer 5 has a constant thickness, the thickness of the membrane 4 varies. Areas with equal thickness are indicated by contour lines (also referred as "isohypses"). As one can see, the material is distributed quite irregularly. This distribution is normally the output of a computer simulation, which helps a speaker designer find an advantageous shape of the membrane 4. It should be noted again that it is not possible to present one single solution, which covers all boundary conditions. Every case rather demands its own solution, that is to say, a special design of the moving system 3. Advantageous manufacturing methods for a membrane 4 as shown in FIG. 10 are rolling, embossing, and molding as the different thickness of the material can be provided quite easily. Another method is to take a small plate of constant thickness and to erode material where it is needed. One tool for this is a laser beam, which vaporizes different amounts of material dot by dot. Yet another method, which is particularly applicable when using a membrane 4 made of metal, is to build up distribution of thickness shown by applying additional layers of material (by means of known metalization processes) or by etching them away.

It should be clear that the moving system 3 of FIG. 10 does not allow the formation of symmetrical standing waves or modes. The modes and nodes are rather distributed quite irregularly, but in such a way that an advantageous frequency response results. Although normally a flat frequency response is aimed for, it is also imaginable that in certain cases a frequency response with one or more peaks is demanded. The question what a moving system looks like can only be answered when looking at the boundary conditions and at the aim.

Figure 11:
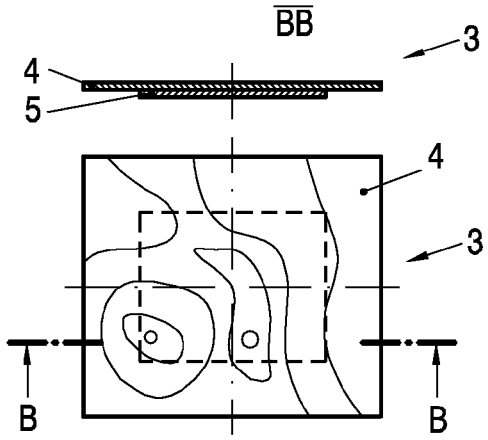
FIG. 11 shows different views of an inventive moving system, having a varying compliance.

FIG. 11 shows the cross section and the top view of another advantageous embodiment of the invention. Here the moving system 3 consists of a membrane 4 and a piezoelectric layer 5, each having constant thickness. Nevertheless, the moving system 3 shows an irregular distribution of the compliance, in the present example provided by inhomogeneities in the material of the membrane 4 or by using different materials for the different sections. Thereby, the Young's modulus is varied, which in turn leads to local variations of the compliance of the moving system 3. Areas with equal compliance are indicated by thin lines (similar to the isohypses mentioned before). It is imaginable to make a membrane 4 made of a polymer harder or softer in particular areas, especially by (locally) controlling the polymerization process or by (locally) applying ultraviolet light.

It should also be noted that although in the preceding examples mainly asymmetries of the membrane 4 were explored, the teachings for the membrane 4 are equally applicable to the piezoelectric layer 5. This means that asymmetrical oscillation characteristics may also be provided by a certain distribution of the thickness of the piezoelectric layer 5 and/or inhomogeneities in the material of the piezoelectric layer 5.

It should further be noted that the teachings and the measures to be taken therefor may also be combined. That means that for example the thickness of a membrane 4 as well as of the piezoelectric layer 5 can be varied. Another example is the combination of inhomogeneities in the material of the piezoelectric layer 5 with the different shaping of the membrane 4 and the piezoelectric layer 5. One will of course appreciate that these are only two examples taken from the plurality of examples and that the presentation of only two examples does not limit the broad scope of the invention.

Figure 12:
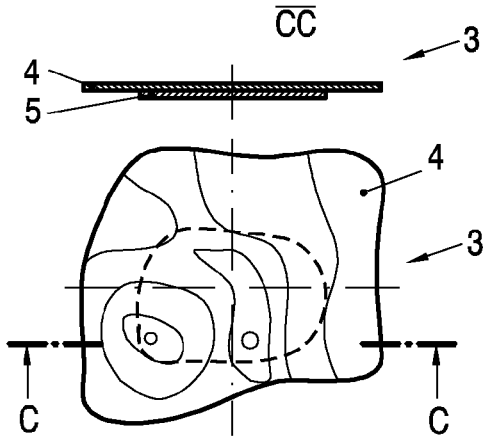
FIG. 12 shows different views of an inventive moving system, comprising an asymmetrically shaped membrane and an asymmetrically shaped piezoelectric layer with additional varying compliance.

One further example illustrating the possibility of combining the teachings is illustrated in FIG. 12, which shows another cross section and top view of an inventive moving system 3 where a membrane 4 and a piezoelectric layer 5 of constant thickness are combined. Inhomogeneities in the material of the membrane 3 as well as different shaping of the membrane 4 and the piezoelectric layer 5 and different centers of gravity lead to a highly asymmetrical moving behavior.

Figure 13:
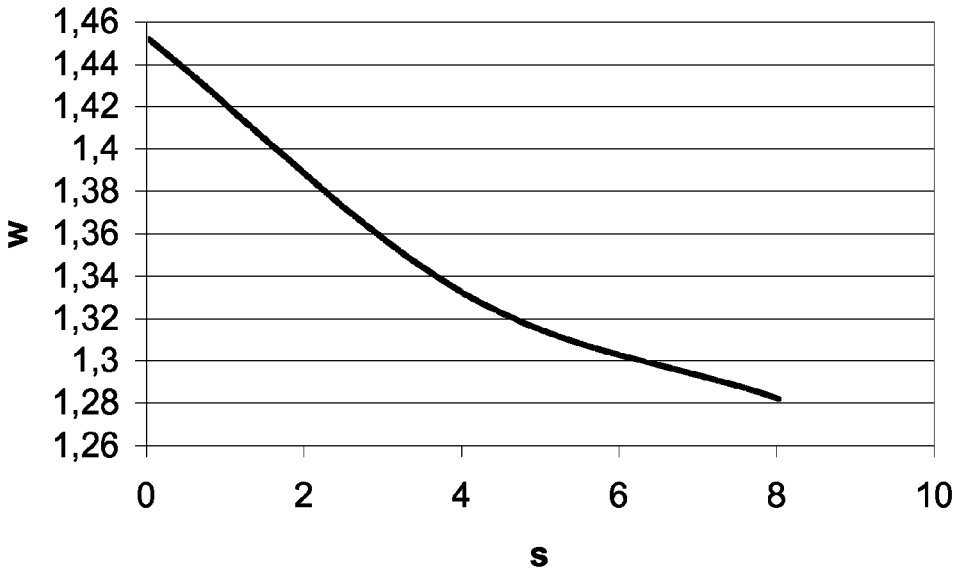
FIG. 13 shows the result of a computer simulation of an inventive moving system.

FIG. 13 shows the result of a computer simulation of an inventive moving system 3. Here a circular piezoelectric layer 5 with a radius of 12.5 mm and a thickness of 0.05 mm was glued to a rectangular membrane 4 with the dimensions 36.5×24.2 mm. In addition, there is a hole in the piezoelectric layer 5 having a diameter of 2 mm, whose position was varied. On the ordinate of the diagram in FIG. 13 there is shown a value w for the ripple in the frequency response of the moving system 3, which value w in the present example is simply the standard deviation. On the abscissa there is shown the distance s (in mm) from the center of said hole to the center of the membrane 4. One will easily perceive that the ripple value w decreases by increasing the distance s of the center of the hole to the center of the membrane.

Figure 14:
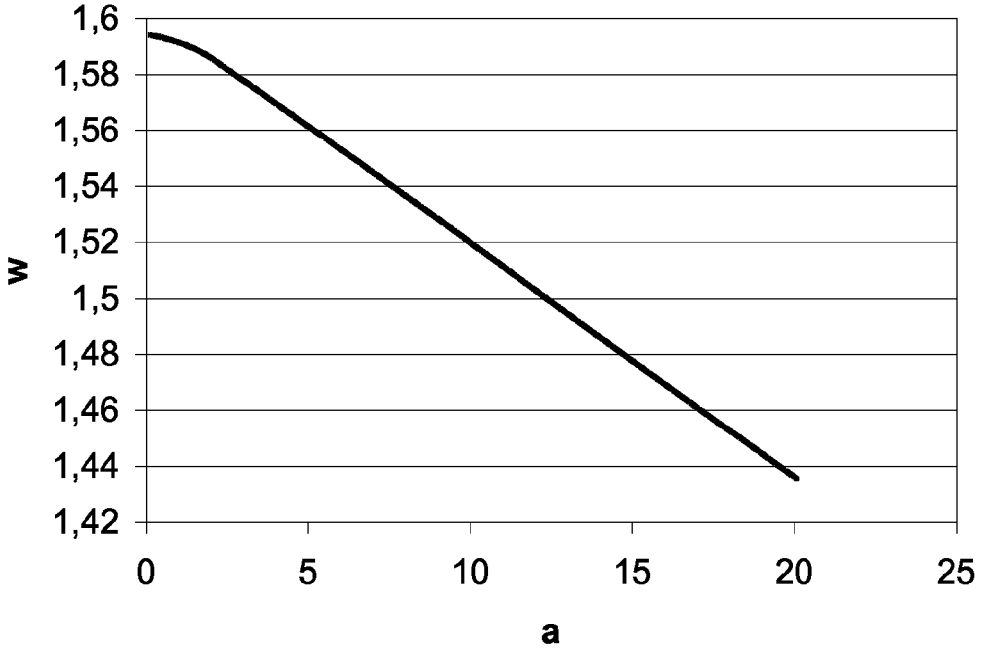
FIG. 14 shows the result of a computer simulation of a further inventive moving system.

FIG. 14 shows the results of yet another computer simulation of an inventive moving system 3. Here a rectangular piezoelectric layer 5 having the dimensions 31×42 mm was glued to a rectangular membrane 4 made of aluminum having the dimensions 48×37 mm. Both the piezoelectric layer 5 and the membrane 4 have a thickness of 100 μm. In this example, the edge of the membrane 4 was not fixed to frame or housing 2 as a whole but only partly. On the ordinate of the diagram in FIG. 14 again there is shown a value w for the ripple in the frequency response of the moving system 3, which value w in the present example again is simply the standard deviation. On the abscissa there is a value a showing the fraction a (in %) of the edge of the membrane 4, which is fixed to the housing 2. One skilled in the art will easily understand that the ripple value w decreases by increasing the fraction a. The lower the part of said fixed edge is, the lower the ripple value w is.

Figure 15:
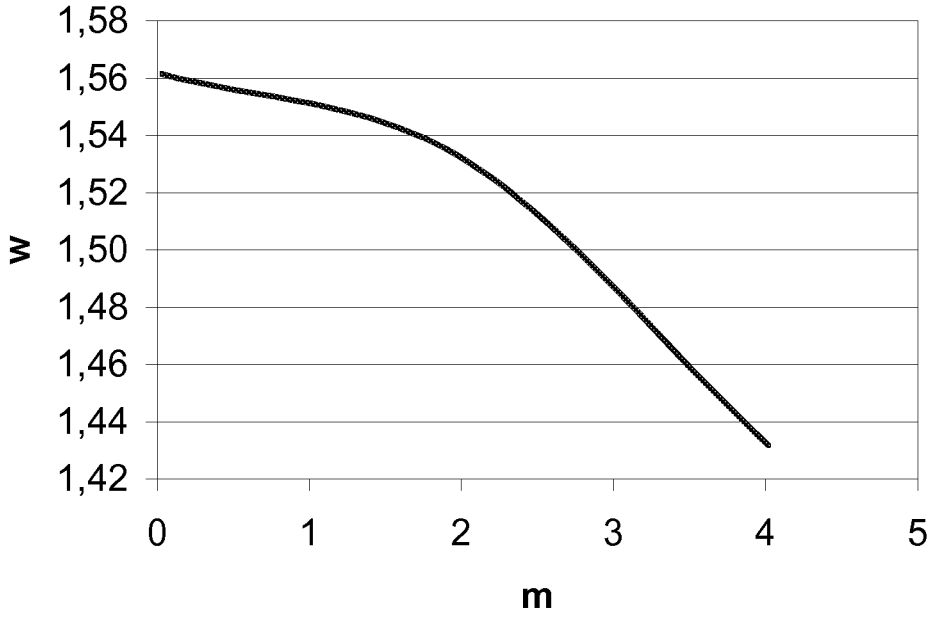
FIG. 15 shows the result of a computer simulation of yet another inventive moving system.

FIG. 15 finally shows a last result of a computer simulation of an inventive moving system 3, which is built up similarly to the one of FIG. 14. Instead of varying the fraction of the fixed membrane edge here a quarter of the moving system 3 has a higher thickness or mass than the rest of the moving system 3. On the ordinate of the diagram in FIG. 15 again there is shown a value w for the ripple in the frequency response of the moving system 3, which value w in the present example again is simply the standard deviation. On the abscissa there is a value m showing the ratio between the mass of said first quarter and one of the remaining quarters of the moving system 3. One skilled in the art will easily appreciate that the ripple value w decreases by increasing the mass ratio m. Increasing the mass may be achieved by simply increasing the thickness of the membrane 4 and/or the piezoelectric layer 5.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, do not exclude the presence of elements or steps other than those listed in any claim or the specification as a whole. The singular reference of an element does not exclude the plural reference of such elements and vice-versa. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A moving system for a piezoelectric speaker comprising a membrane and a piezoelectric layer attached thereto, wherein a movement of the moving system in a main direction is substantially caused by dilatation/contraction of the piezoelectric layer transverse to said main direction, said movement causing the generation of sound, wherein the moving system possesses moving characteristics, and wherein said moving system is configured asymmetrically with respect to the moving characteristics of the moving system.

2. The moving system as claimed in claim 1, wherein local moving characteristics are asymmetrical with respect to any point in the plane of the moving system.

3. The moving system as claimed in claim 2, wherein local compliance is asymmetrical with respect to any point in the plane of the moving system.

4. The moving system as claimed in claim 2, wherein the shape of the moving system is asymmetrical with respect to any point in the plane of the moving system.

5. The moving system as claimed in claim 1, wherein the moving system is symmetrical about a single axis with respect to the moving characteristics.

6. The moving system as claimed in claim 1 wherein the membrane and the piezoelectric layer differ in shape.

7. The moving system as claimed in claim 1, wherein the membrane and the piezoelectric layer are of the same shape.

8. The moving system as claimed in claim 1, wherein the center of gravity of the membrane and the center of gravity of the piezoelectric layer are spaced apart.

9. The moving system as claimed in claim 1, wherein the area of the piezoelectric layer is greater than 20 % of the total membrane area.

10. The moving system of claim 1, wherein the piezoelectric layer is attached to the membrane such that the distance between the center of gravity of the membrane and the center of gravity of the piezoelectric layer is at least ten percent of the longest dimension of the moving system.

11. A piezoelectric speaker comprising:

a housing; and a moving system attached to the housing, the moving system comprising:

a membrane, the membrane having an excitation area and an edge area surrounding the excitation area, wherein the membrane is coextensive with the moving system; and a piezoelectric layer attached to the excitation area of the membrane, the piezoelectric layer sized to be at least as large as the excitation area, wherein the piezoelectric layer is configured to dilate or contract in a direction transverse to its thickness when a voltage is applied to the piezoelectric layer;

wherein the dilatation or contraction of the piezoelectric layer causes the excitation area of the membrane to bend in a direction transverse to the direction of the dilatation or contraction; and wherein the moving system is configured asymmetrically with respect to the moving characteristics of the moving system.

12. The piezoelectric speaker of claim 11, wherein the piezoelectric layer is sized to be coextensive with the membrane.

13. The piezoelectric speaker of claim 11, wherein the bending of the excitation area of the membrane in a direction transverse to the direction of the dilatation or contraction of the piezoelectric layer causes sound to be generated.

* * * * *

UNITED STATES PATENT AND TRADEMARK OFFICE

CERTIFICATE OF CORRECTION

PATENT NO. : 8,594,348 B2
APPLICATION NO. : 12/093633
DATED : November 26, 2013
INVENTOR(S) : Windischberger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1049 days.

Signed and Sealed this
Twenty-second Day of September, 2015

Michelle K. Lee

Michelle K. Lee
*Director of the United States Patent and Trademark Office*